US010287084B2

(12) United States Patent
Yahalom

(10) Patent No.: US 10,287,084 B2
(45) Date of Patent: May 14, 2019

(54) CONTAINER ASSEMBLY FOR SEPARATED FLOWABLE CONTAINERS

(71) Applicant: Amram Yahalom, Woodland Hills, CA (US)

(72) Inventor: Amram Yahalom, Woodland Hills, CA (US)

( * ) Notice: Subject to any disclaimer, the term of this patent is extended or adjusted under 35 U.S.C. 154(b) by 95 days.

(21) Appl. No.: 15/602,088

(22) Filed: May 22, 2017

(65) Prior Publication Data

US 2018/0334286 A1 Nov. 22, 2018

(51) Int. Cl.

| | |
|---|---|
| ***B65D 1/02*** | (2006.01) |
| ***B65D 21/02*** | (2006.01) |
| ***B65D 41/04*** | (2006.01) |
| ***B65D 81/32*** | (2006.01) |

(52) U.S. Cl.

CPC ..... *B65D 81/3216* (2013.01); *B65D 1/0246* (2013.01); *B65D 21/02* (2013.01); *B65D 21/0233* (2013.01); *B65D 41/04* (2013.01)

(58) Field of Classification Search

CPC ..... B65D 81/3216; B65D 21/0233

USPC ..... 220/504, 23.89; 215/6; 411/307, 308

See application file for complete search history.

(56) References Cited

U.S. PATENT DOCUMENTS

| | | | | |
|---|---|---|---|---|
| 3,590,989 | A * | 7/1971 | Wittwer | B65D 21/0237 206/459.5 |
| 4,438,870 | A * | 3/1984 | Stull | B65D 47/242 222/48 |
| 5,353,964 | A | 10/1994 | Liu et al. | |
| 5,996,781 | A * | 12/1999 | Glaser | A47G 19/2227 206/217 |
| 6,325,229 | B1 * | 12/2001 | Anders | B65D 21/0204 215/6 |
| 6,945,419 | B2 * | 9/2005 | Bertazza | A45D 40/265 220/23.87 |
| 6,989,168 | B2 * | 1/2006 | Fahey | B65D 1/04 206/217 |
| 2009/0211927 | A1 | 8/2009 | Wu | |
| 2012/0018337 | A1 | 1/2012 | Furey | |

FOREIGN PATENT DOCUMENTS

| | | |
|---|---|---|
| CN | 103449001 | 12/2013 |

* cited by examiner

*Primary Examiner* — Fenn C Mathew
*Assistant Examiner* — Jennifer Castriotta

(57) ABSTRACT

A container assembly consisting of an outer container and an inner container is provided. The outer container has a recess that conforms in its shape to the shape of the inner container, whereby a cavity is formed in the outer container between the outer walls of the outer container and the walls of the recesses. When the containers are filled with flowable materials and are assembled, both flowable materials are isolated from each other and are not miscible. The containers have engageable threads on the mating surfaces so that the inner container can be inserted into the outer container by twisting. The unique feature of the assembly is a provision of one, two, or three locking means for securing the containers in the assembled state.

9 Claims, 7 Drawing Sheets

CONTAINER ASSEMBLY FOR SEPARATED FLOWABLE CONTAINERS

CROSS-REFERENCE TO RELATED APPLICATIONS

This application is a continuation of U.S. application Ser. No. 13/858,653, filed Apr. 8, 2013.

BACKGROUND

Field of the Invention

This invention relates generally to containers, and more particularly, to a container assembly that consists of two or more connectable and disconnectable containers assembled into a single unit where one container is inserted into the other and where the contents of the assembled containers are separated and therefore not miscible. More specifically, the invention concerns two containers inserted one into the other and containing two different or similar flowable materials, e.g., liquids kept separated and thus not miscible when the containers are in an assembled state.

Description of the Prior Art

Under certain circumstances, a need may occur in combining two or more containers into a single unit for convenience of transportation and use of two or more different contents separated from each other and prevented from mixing.

Heretofore, containers of the aforementioned type have been known and their description and structures may be found in many patent publications.

For example, nestable beverage containers having interlocking features with adjacent containers are disclosed in US Patent Application Publication No. 20120018337 (issued: Jan. 26, 2012; inventor: James Furey). According to this disclosure, each container has a recess with an internal thread in the bottom which conforms to the shape of the upper end of the next connectable container. The upper end of each container has an external thread that is engageable with the internal thread at the bottom of the receiving container. Thus, in an assembled state a number of containers are assembled into a prolonged cylindrical body convenient for transportation.

U.S. Pat. No. 5,353,964 issued on Oct. 11, 1994 to Y. Liu, et al. discloses a twin-bottle assembly that includes an outer bottle having a mouth at the top, an outer cap fastened to the mouth of the outer bottle through a screw joint to hold a nipple, an inner bottle disposed inside the outer bottle, a cup-like inner cap supported above the mouth of the outer bottle to hold the inner bottle inside the outer bottle; and a diversion control switch received within the outer cap between the nipple and the cup-like inner cap. The cap can be turned to let a first fluid in the outer bottle or a second fluid in the inner bottle flow into the nipple for suction by a baby or to let both the first and second fluids flow into the nipple simultaneously.

Chinese Patent Application Publication No. CN No. 103449001 (issued on Dec. 18, 2013; inventors to Xu Lei, et. al.) discloses a double-bottle structure with jacketed inner bottle. A jacket surrounds the inner bottle body, and the upper end and the lower end of the jacket are fixed on the peripheral face of the inner bottle body so that a cavity is formed between the jacket and the inner bottle body. This cavity is filled with a liquid of an appropriate color which masks the image of the inner bottle and in combination with the color of another liquid that fills the inner bottle body produces a visual effect of a dazzling ornament when the bottle assembly is moved or turned over.

US Patent Application Publication No. 20090211927 (issued date: Aug. 27, 2009; inventor: k. Wu) discloses a container structure for different beverages which, comprises an outer container, an inner container and a cap. The outer container of an integral hollow body includes a holding hollow cavity encompassed by an open top surface, a bottom surface and a barrel-shaped lateral surface, a protruding round stud with an external male thread on the outer peripheral thereof being integrally disposed in the internal center of the bottom surface, and a neck spout opening with external male thread on the outer peripheral thereof. The inner container of hollow tubular body has an external male thread formed on the upper end thereof and an internal female thread formed in the lower end thereof; and the cap includes an open hollow cavity encompassed by a closed top surface, an open bottom surface and a cylindrical lateral surface with internal female thread formed inner wall thereof, a protruding nut hoop with internal female thread formed inside thereof being integrally disposed in the internal center of the top surface. Upon the cap being rotated to depart away the outer container, the inner container is concurrently detached away the outer container and two beverages immediately mix with each other. Thus, the structure of the aforementioned publication is intended for providing double-bottled assembly for either easy and quickly mixing two different liquids when desired, or for preventing an accidental mixing of the liquids when it is undesirable.

SUMMARY OF THE INVENTION

This invention relates generally to containers, and more particularly, to two containers inserted one into the other and containing two different or similar liquids kept separated and thus not miscible when the containers are in an assembled state. More specifically, the container assembly consists of an external container, for example, an external bottle, and an inner container, for example, an inner bottle. Both bottles may contain the same or different flowable contents such as liquids or powders. The outer bottle has an inner-bottle receiving cavity which conforms in its shape to the outer shape of the inner bottle so that, when the inner bottle is inserted into the inner-bottle receiving cavity, it completely fills this cavity and is held entirely inside the outer bottle without protruding beyond the outlines of the latter.

The interior of the outer bottle forms a first sealable cavity for containing a first liquid. The outer bottle has a recess for insertion of a second bottle and this recess does not fill the entire interior of the outer bottle so that a space still remains inside the outer bottle between the inner surface of the outer wall of the outer bottle and the outer side of the recess which forms an inner-bottle receiving cavity.

It is understood that both cavities can be sealed by closing the upper ends of the bottles with respective caps, e.g., by screwing the caps on the threaded mouths of the respective bottles.

For securing both bottles in an assembled state, the outer surface of the inner bottle has a first thread, i.e., an internal thread, and the outer surface of the inner-bottle receiving cavity has an external thread so that for assembling of the bottles into an integral unit, the inner bottle is threaded into the outer bottle. The inner bottle is shorter than or equal to the depth of the inner-bottle receiving cavity of the outer bottle. Therefore, in an assembled state the inner bottle remains without the outlines of the outer bottle so that the end face or bottom of the inner bottle is located deeper or in flush with the bottom of the outer bottle.

For convenience of insertion of the inner bottle into the outer bottle, a gripping portion is formed in the bottom of the inner bottles, e.g., in the form of recesses, e.g., two diametrically opposite recesses for user's fingers. The recesses have a depth sufficient for insertion of the fingers and walls substantially perpendicular to the bottom surface for use as abutments for fingers.

A distinguishing feature of the container assembly of the present invention is that both containers, i.e., bottles, are additionally provided with at least one locking means for securely locking the bottles in the final assembled position. The locking means is formed by snapping engagement between a projection on one of the threads and a recess or dimple on the other of the thread. The height of the projection exceeds the thickness of the gap between the threads so that, when the inner bottle reaches its final position in the outer bottle, the projection is aligned with the recess and is snapped in it. The depth of the recess ensures snug fit of the projection.

The assembly may be provided with an additional. i.e., a second locking means that may be used independently or simultaneously with the first locking means and is based on a similar interaction between the second projection and a second recess with the difference that the projection and recess are formed on the mating cylindrical surfaces of the bottles, i.e., in the form of an annular ridge on the outer surface of the inner bottle and an annular groove on the mating surface of the inner-bottle receiving cavity, or vice versa. A third locking means that may be used independently or simultaneously with the first or a second locking means or with both of them is a gradually reduced gap or backlash between the interacting threads. In other words, the gap between the external and internal threads of both bottles varies from a loose fit at the beginning of the bottled assembling operation to a snug fit when the inner bottle reaches its final position in the inner-bottle receiving cavity of the outer bottle. As a result, the snug fit will secure the inner bottle inside the outer bottle due to friction between the interacting surfaces of the mutually engaged thread.

The bottles may be disconnected from each other by applying an insignificant force but the disconnection force is much higher than the locking force of the snapping or friction means that holds the bottles together.

The inner container and the outer container may be comprised of a suitable material or materials, for example, of polystyrene, polyurethane, glass, or other material, for enabling connection and disconnection thereof. The relative sizes of the containers may be the sizes of standard white wine bottles for the outer bottle, and a smaller size bottle for the red wine inner bottle. It is preferable that the bottle materials are transparent, although the use of non-transparent materials is also within the scope of the present invention.

Although there are no special restrictions with regard to the dimensions of the bottles, for bottles of the aforementioned type it is recommended to maintain the backlash between the mating threads of the inner and outer bottles in the following range: H from 2 mm to 0.38 mm and a from 5° to 2.8°, where a is a taper angle and H is the gap or backlash value in the middle of the threaded connection in the assembled state of the bottles. It is meant that in the assembled state of the bottles the maximum value of the H selected in the indicated range is a value of the gap between the external and internal threads at the lower end face of the assembly and that at the opposite end of the threaded connection there will be no gap at all and the threads will have a snug fit.

In use, the cavity of the outer bottle, i.e., the first sealable cavity, is filled with a first flowable contents, e.g., a white wine, the interior of the inner bottles is filled with the second flowable content, e.g., a red wine. Both bottles are sealed with respective caps.

When it is necessary to assemble both bottles into a compact unit that is suitable for placing into a small carry-on bag, rucksack, backpack, etc., and go, e.g., to picnic, a user inserts the inner bottle filled with one content into the outer bottle filled with another content by screwing the thread of the inner bottle into the thread of the outer bottled. When the inner bottle reaches its final assembled position, it is fixed in this position by one, two, or all three locking means. Since in the assembled state the contents of both bottles are physically isolated, they are prevented from mixing.

When it is necessary to use the separated liquids, the bottles are disconnected by unscrewing the inner bottle from the outer bottle by inserting fingers of one hand into the recesses in the bottom of the inner bottle and twisting the inner bottles in the unscrewing direction while holding the outer bottle with fingers of the other hand.

DETAILED DESCRIPTION OF THE INVENTION

This invention relates generally to containers, and more particularly, to two containers inserted one into the other and containing two different or similar liquids kept separated and thus not miscible when the containers are in an assembled state. In the following context, just exemplarily the containers will in some places be referred to as bottles.

Figure 1:
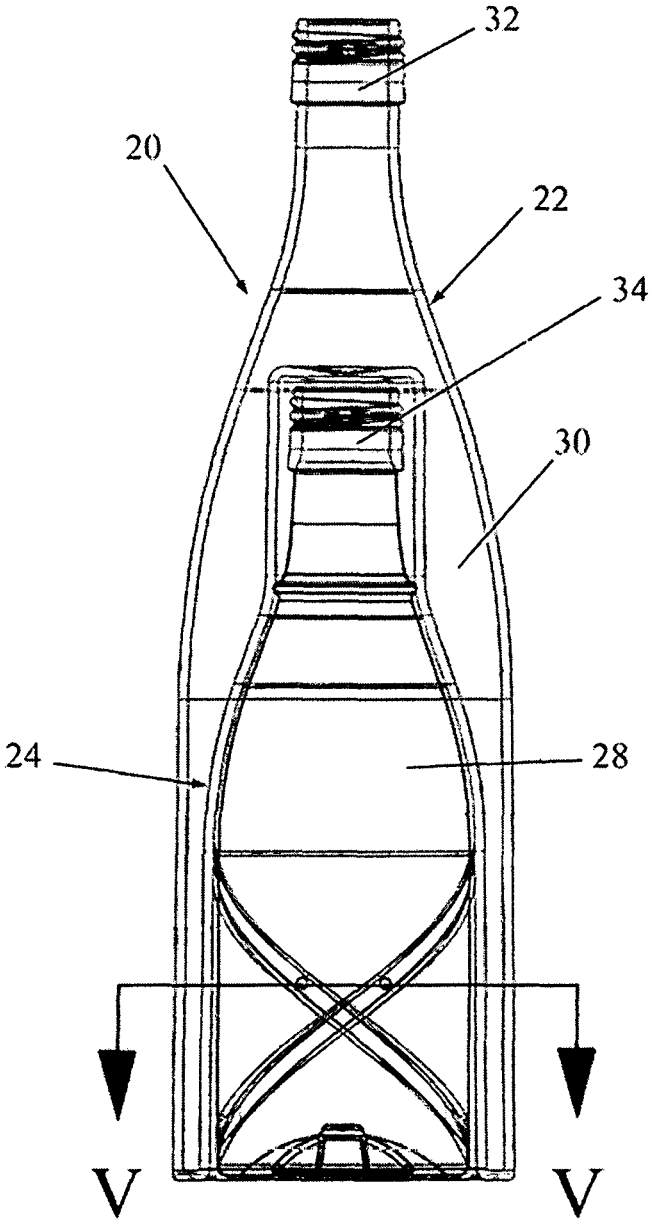
FIG. 1 is a longitudinal cross-sectional view of the outer and inner bottle bottles of the invention in an assembled state.
Figure 2:
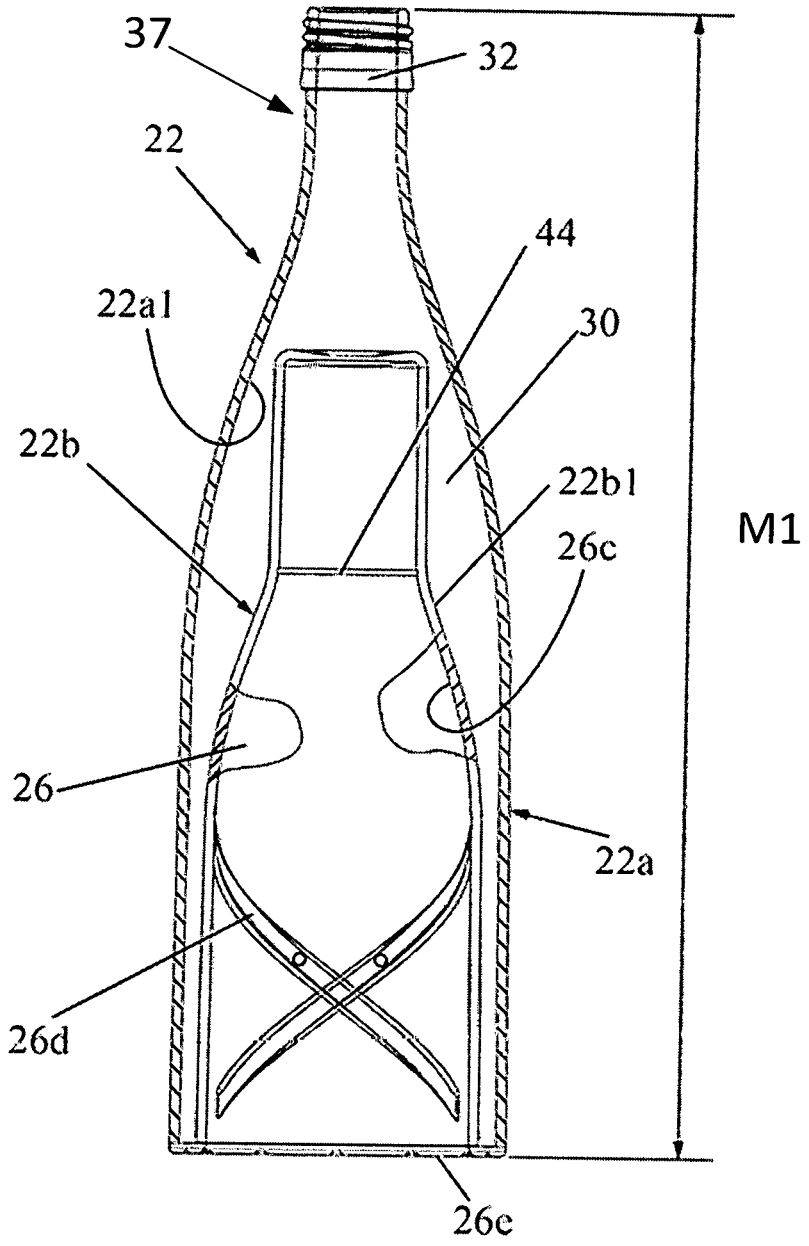
FIG. 2 is a longitudinal sectional view of an outer bottle used in the assembly of the invention.
Figure 3:
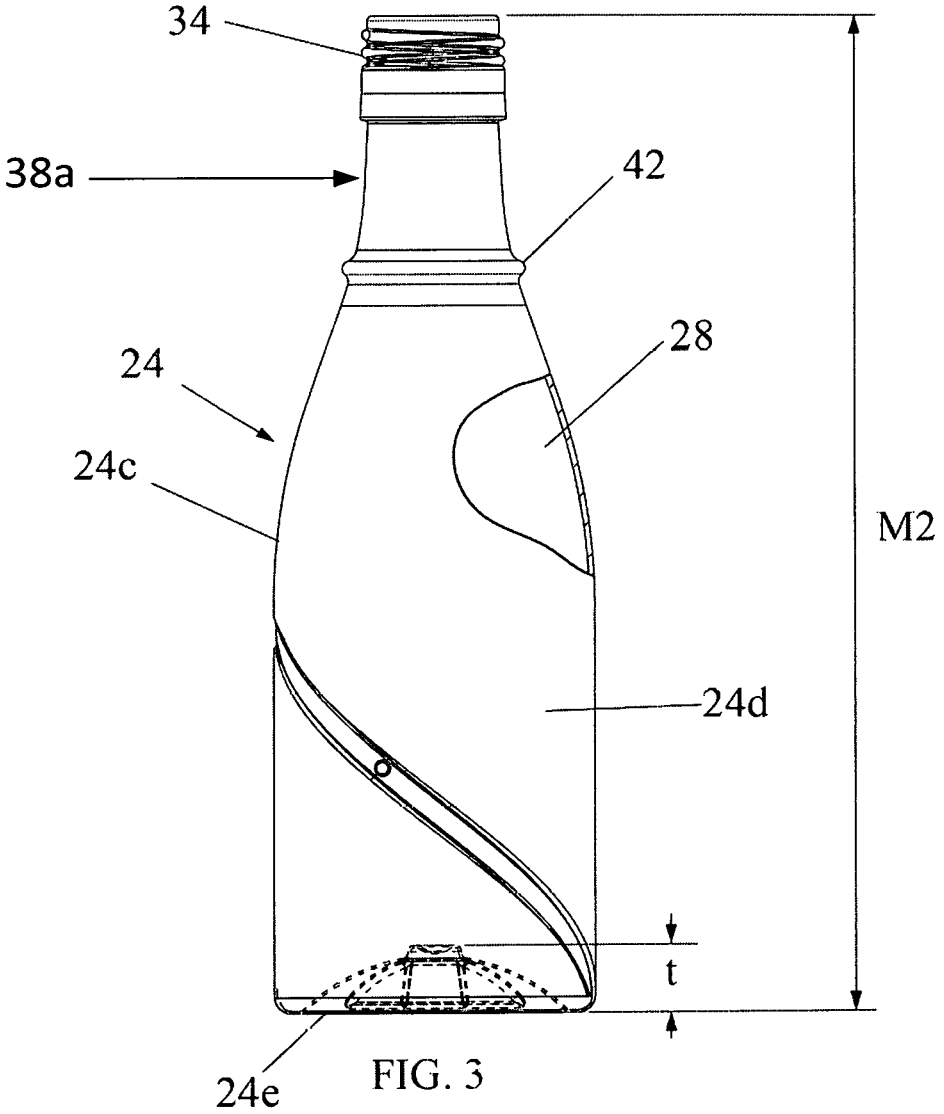
FIG. 3 is a side view of an inner bottle used in the assembly of the invention.

The present invention will now be described in more detail with reference to the accompanying drawings, wherein FIG. 1 is a longitudinal cross-sectional view of the outer and inner bottle bottles in an assembled state. More specifically, the container assembly, which is in general is designated by reference numeral 20, consists of an outer bottle 22 having a length M1 and an outer wall 22*a* and an inner bottle 24 having a length M2 and an outer side 24*c*, where the M1 is greater than the length M2. The outer wall 22*a* has an inner side 22*a*1. Both bottles are shown empty but may contain different or the same flowable contents such as liquids or powders. FIG. 2 is a longitudinal sectional view of the outer bottle, and FIG. 3 is a side view of the inner bottle.

As can be seen from FIG. 2, the outer bottle 22 has an inner-bottle receiving cavity 26 which has a shape to conforms to the outer shape of the inner bottle 24 (FIG. 3) so that, when the inner bottle 24 is inserted into the inner-bottle receiving cavity 26 of the outer bottle 22, it completely fills this cavity and is held entirely inside the outer bottle 22 without protruding beyond the outlines of the latter.

The interior of the inner bottle 24 forms a sealable cavity 28, which hereafter will constitute a second sealable cavity for containing a second flowable material, e.g., a liquid (not shown). On the other hand, the inner-bottle receiving cavity 26 does not fill the entire interior of the outer bottle, and a first sealable cavity, i.e., a space 30 still remains inside the outer bottle 22 between the inner side 22*a*1 of the wall of the outer bottle 22 and a recess wall 22*b* of the inner-bottle receiving cavity 26. The recess wall has an inner side 26*c* and an outer side 22*b*1.

It is understood that both cavities 26 and 28 can be sealed by closing the upper ends of the bottles with respective caps, e.g., by screwing caps 32 and 34 on the threaded mouths of the respective bottles.

For inserting the inner bottle 24 into the outer bottle 22, the outer side 24*c* of the inner bottle 24 has a first thread, i.e., an internal thread 24*d*, and the outer surface 26*c* of the inner-bottle receiving cavity 26 has an external thread 26*d* so that for assembling of the bottles into an integral unit, the inner bottle 24 is screwed into the outer bottle 22.

The threads may be a left-hand or a right-hand thread with a helix angle, e.g., in the range of 30° to 50° with a rectangular profile in cross section. The width of the thread may vary, e.g., from 3 mm to 15 mm, and the thread pitch may be in the range of, e.g., 20 mm to 80 mm. The depth of the internal thread, and hence, the height of the external thread, may vary in the range of 0.5 mm to 3 mm. These values are just practical examples and do not limit the scope of the invention. It is understood that actual geometry of the threads will depend on the size of the containers, thickness of their walls, and the like.

The inner bottle 24 is shorter than or equal to the depth of the inner-bottle receiving cavity 26 of the outer bottle 22. Therefore, in an assembled state (FIG. 1) the inner bottle remains within the outlines of the outer bottle so that the end face or bottom 24*e* of the inner bottle 24 is located deeper or in flush with the bottom 26*e* of the outer bottle 22. It is understood that the internal thread can be formed on the inner bottles and the external on the outer bottles or vice versa, i.e., the internal thread can be formed on the outer surface of the inner-bottle receiving cavity 26 and the external thread can be formed on the outer surface of the inner bottles.

Figure 4:
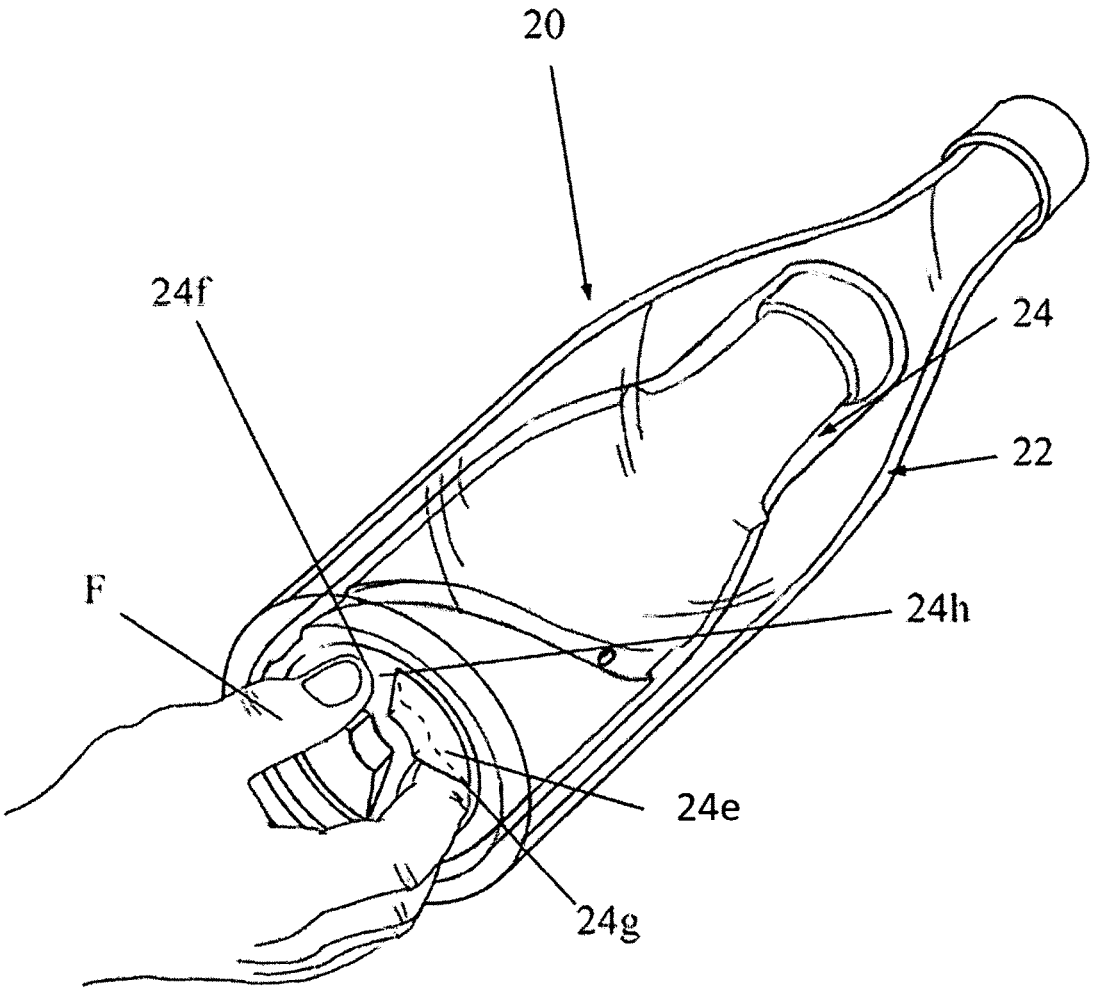
FIG. 4 is a perspective rear view of the bottles of the invention in the assembled state.

For convenience of insertion of the inner bottle 24 into the outer bottle 22, a gripping portion is formed in the bottom of the inner bottles, e.g., in the form of recesses, e.g., two diametrically opposite recesses for user's fingers (see FIG. 4, which is a perspective rear view of the bottles 22 and 24 in the assembled state). It can be seen that the bottom 24*e* of the inner bottled 24 (FIG. 3) has recesses or deepenings 24*f* and 24*g*. The deepenings 24*f* and 24*g* have depths "t" (FIG. 3) sufficient for insertion of the user's fingers F and walls 24*h* and 24*i* substantially perpendicular to the bottom surface for use as abutments for the fingers.

A distinguishing feature of the container assembly 20 of the present invention is that both containers, i.e., bottles 22 and 24, are additionally provided with at least one locking means for securely locking the bottles in the final assembled position.

Figure 5:
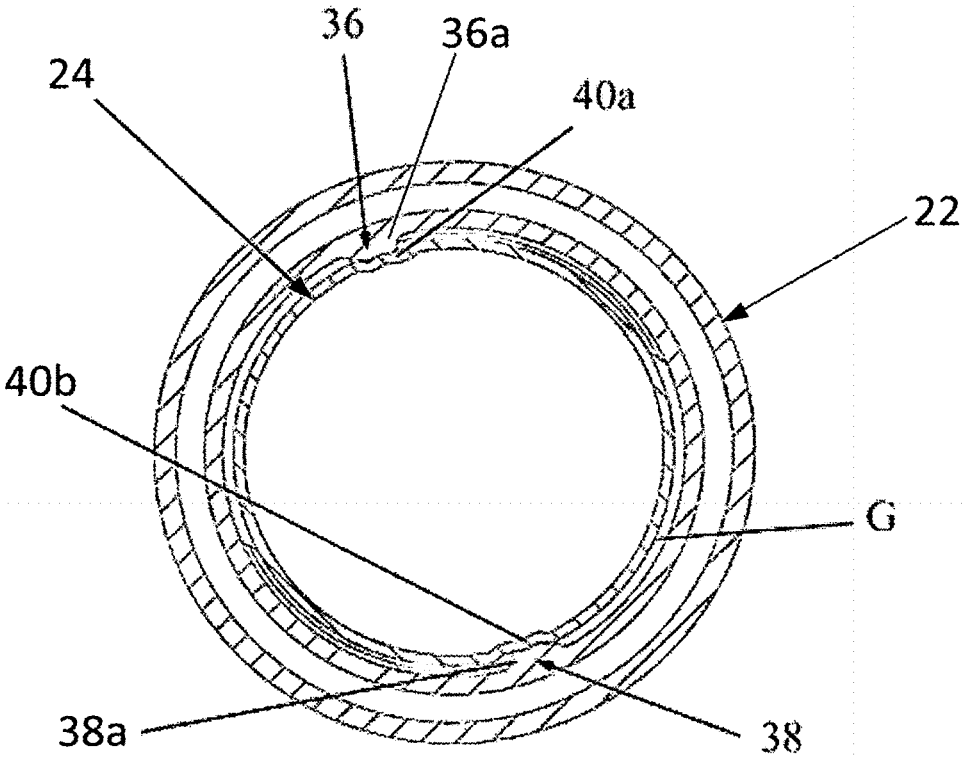
FIG. 5 is a cross-section along the line V-V of FIG. 1.

According to one aspect of the invention, the locking means is formed by snapping engagement between at least one projection on one of the threads and a dimple on the other of the threads. Two such snapping engagements 36 and 38 are shown as examples in FIG. 5, which is a cross-section along the line V-V of FIG. 1. In the illustrated case, projections 36*a* and 38*a* are formed on the external thread 26*d* of the outer bottle, and the dimples or recesses 40*a* and 40*b* are formed on the internal thread 24*d*. It is possible, within the scope of the invention, to form projections on the internal thread and dimples or recesses on the external thread.

Snapping is provided by making the height of the projection 36*a* and 38*a* slightly higher than the thickness of the gap G between the threads so that, when the inner bottle 24 reaches its final position in the outer bottle 22 (i.e., the position shown in FIG. 1), the projections 36*a* and 38*a* are aligned with the recesses 40*a* and 40*b* and are snapped in them. The depth of the recesses ensures snug fit of the projections in the dimples. According to another aspect of the invention, the assembly 20 may be provided with an additional. i.e., a second locking means that may be used independently or simultaneously with the above-mentioned projections and dimples on the threads. The second locking means is based on a similar interaction between a circular ridge 42 (FIG. 3) on the outer surface of the neck 38*a* (FIG. 3) of the inner bottled 24 and an annular groove or recess 44 (FIG. 2) formed on the mating surface of the inner-bottle receiving cavity 26, or vice versa. In other words, the ridge can be formed on the surface of the inner-bottle receiving cavity 26 and the annular recess can be formed on the neck of the inner bottle. Similar to the case of the first locking means, the height of the ridge and the depth of the annular recess are selected so as to provide an easily separable snapping connection.

According to still another aspect of the invention, the bottle assembly 20 may have a third locking means suitable for use independently and/or simultaneously with the first and/or a second locking means or with both of them simultaneously. This third locking means comprises a gradually reduced helical gap or backlash G (FIG. 5) between the tip of the external thread 26*d* and the valley of the interacting internal thread. In other words, the gap G between the external and internal threads of both bottles varies from a loose fit at the beginning of the bottled assembling operation to a snug fit when the inner bottle reaches its final position (FIG. 1) in the inner-bottle receiving cavity 26 of the outer bottle 22. As a result, the snug fit will secure the inner bottle 24 inside the outer bottle 22 due to friction between the interacting surfaces of the mutually engaged threads.

The bottles may be disconnected from each other by applying an insignificant force but the disconnection force is much higher than the locking force of snapping or friction that hold the bottles together.

The inner container and the outer container, which in the illustrated case are bottles, may be made of a suitable material or materials, for example, of polystyrene, polyurethane, glass, or other materials, for enabling connection and disconnection thereof. The relative sizes of the containers may be the sizes of standard white wine bottles for the outer bottle, and smaller size standard bottles for the red wine inner bottle. The red and white wines are mentioned just exemplarily. It is preferable that the bottle materials are transparent, although the use of non-transparent materials is also within the scope of the present invention.

Figure 6:
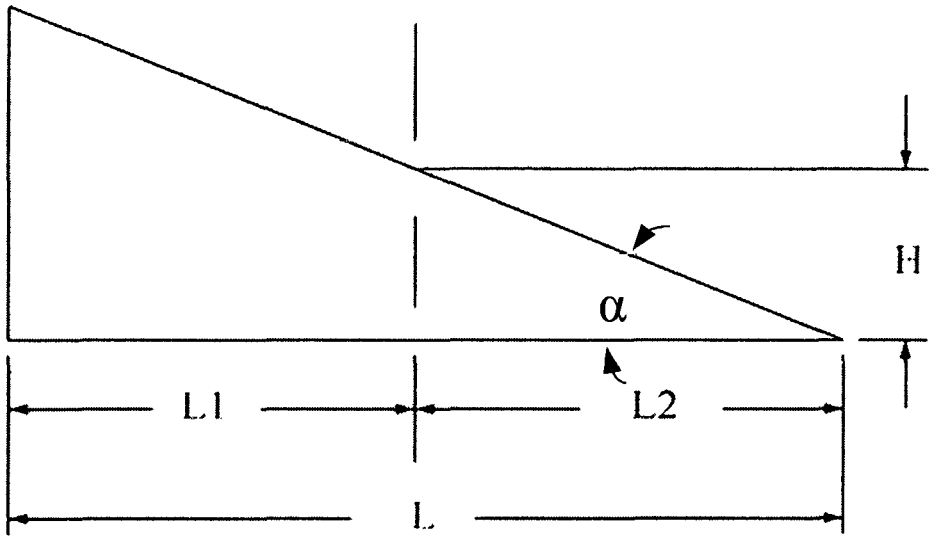
FIG. 6 is a development of the gap between the threads in the longitudinal direction of the assembly from the bottom to the neck.

Although there are no special restrictions with regard to the dimensions of the bottles, for bottles of the aforementioned type it is recommended to maintain the backlash between the mating threads 24*d* and 26*d* of the inner and outer bottles in the following range: H from 2 mm to 0.38 mm and a from 5° to 2.8°, where a is a taper angle and H is the backlash value in the middle of the threaded connection in the assembled state of the bottles. It is meant that in the assembled state of the bottles (FIG. 1) the maximum value of the H selected in the indicated range is a value of the gap between the external and internal threads at the bottom side of the assembly and that at the opposite end of the threaded connection there will be no gap at all and the threads will have a snug fit. This is shown in FIG. 6, which is a development of the gap G, where H is shown in the middle of the threads, i.e., L1=L2, where L is the length of the gap development, i.e., the length of the thread.

In use, the cavity of the inner bottle 24, i.e., the second sealable cavity 28, is filled with one flowable contents, e.g., a red wine (not shown), and the inner bottle is sealed by threading a respective cap 34 onto the threaded mouth 37 of the inner bottle 24. The interior of the outer bottle 22, i.e., the first sealable cavity 30, is filled with a first flowable content, e.g., a white wine (not shown), and the first sealable cavity 30 is then sealed by screwing a respective cap 32 onto the threaded mouth 37 of the outer bottle 22.

When it is necessary to assemble both bottles into a compact assembly 20 that is suitable for placing into a small carry-on bag, rucksack, backpack, etc., and go, e.g., to picnic, a user inserts the inner bottle 24 filled with one content into the outer bottle 22 filled with another content by screwing the thread 24*d* of the inner bottle into the thread 26*d* of the outer bottled 22. When the inner bottle 24 reaches its final assembled position (FIG. 1), it is fixed in this position by one, two, or all three locking means described above, i.e., by projections 36, 38 and recesses 36*a*, 38*a*, and/or by the ridge 42 and the annular recess 44, and/or by the friction on the threads 24*d* and 26*d*. Since in the assembled state the contents of both bottles are physically isolated, they are prevented from mixing.

Figure 7:
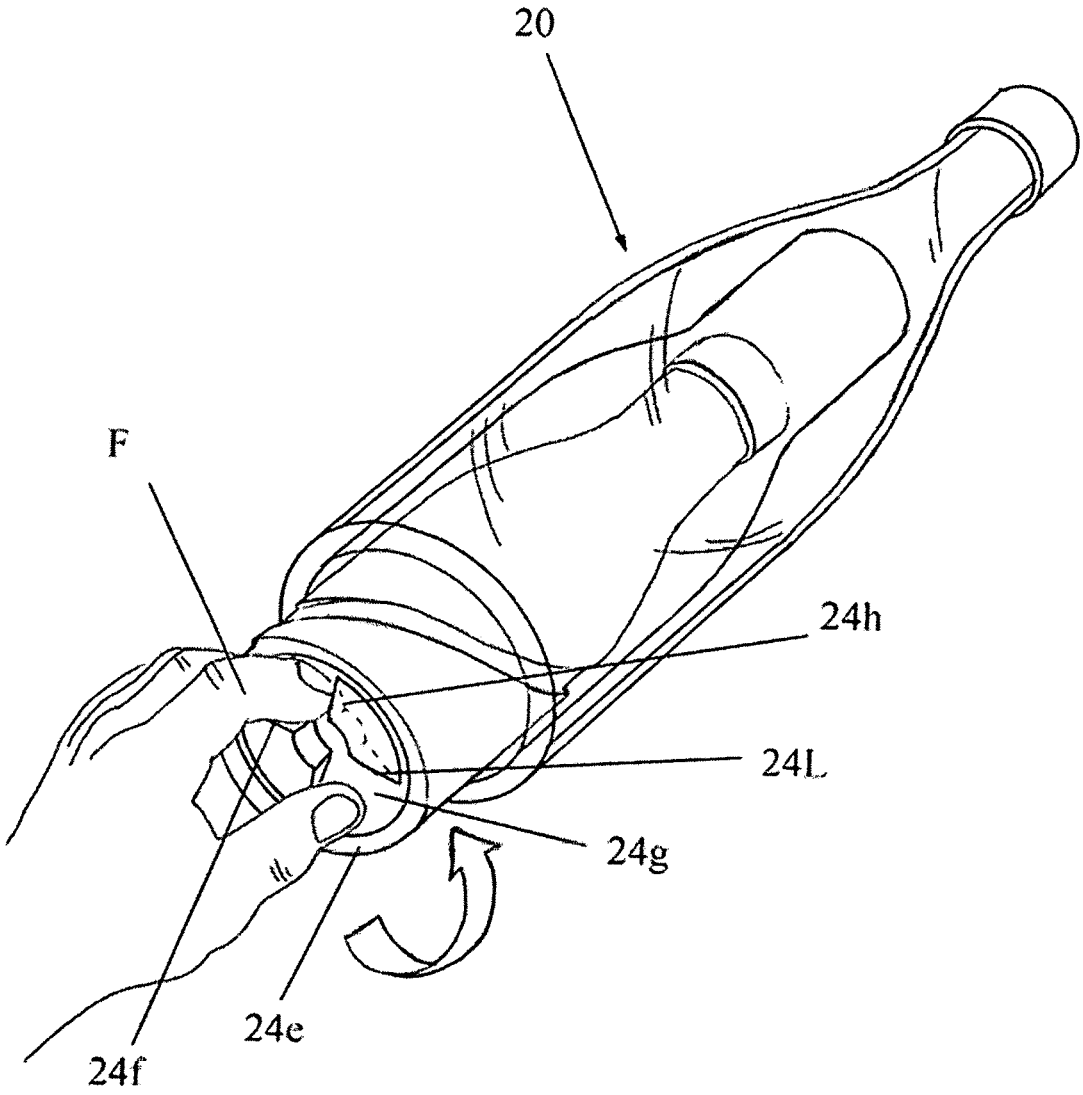
FIG. 7 is a perspective rear view of the bottle assembly of the invention illustrating the removal of the inner bottle by untwisting it from the outer bottle.

When it is necessary to use the separated liquids, the bottles 22 and 24 are disconnected by unscrewing the inner bottle 24 from the outer bottle 22 by inserting the fingers on one hand of the user (see FIG. 7) into the deepenings 24*f* and 24*g* in the bottom of the inner bottle 24 and twisting the inner bottles in the unscrewing direction (in the illustrated case, in the counterclockwise direction) while holding the outer bottle 22 within the fingers of the other hand.

The invention has been described and shown with reference to specific examples. It is understood that these examples should not be construed as limiting the application of the invention and that any changes and modifications are possible without deviation from the scope of the attached patent claims. For example, the outer container may have a rectangular external shape, provided that the inner-bottle receiving cavity has the shape of a body of rotation with an internal or external thread, depending on what thread is needed for engagement with the mating thread of the inner bottle. Both bottles may contain the same contents.

Both containers may contain powders or liquids, or one container may contain a liquid and the other a powder.

What I claim is:

1. A container assembly for separated flowable contents comprising:

a first container having a bottom surface, a length, an outer wall having an inner side, a recess that has a shape and a recess wall that has an inner side and an outer side and that extends in the direction from the bottom surface of the first container inward to a part of the length thereof, and a first sealable cavity for a first content formed between the inner side of the outer wall of the first container and the outer side of the recess wall;

a second container having a bottom surface, a wall having an outer side, and a second sealable cavity formed inside the second container for a second content, the second container having an outer shape conforming to the shape of the recess of the first container;

a first thread on the outer side of the recess wall, and a second thread formed on the outer side of the wall of the second container which is engageable with the first thread through a threading connection therebetween, the first thread and the second thread forming mating threads; and a first locking means for locking the second container inside the first container when the second container is inserted into the first container to a state of complete assembling by threading the second thread into the first thread to the end of the threading, wherein the first locking means comprises a gap between the thread of one of the containers and the thread of the other container which gradually decreases over the entire length of both threads from a loose fit between the threads to a snug fit in said state of complete assembling for locking the second container in the first container.

2. The container assembly according to claim 1, further comprising a second locking means in a form of at least one projection on one of the threads and at least one dimple on the other of the threads, the projection and the dimple being located on the respective threads in positions which are aligned in said state of complete assembling and provide a snapping action between the projection and the dimple when aligned for locking the second container in the first container.

3. The container assembly according to claim 2, further provided with a third locking means comprising a circular ridge on one of the containers and an annular recess on the other of the containers, the circular ridge and the annular recess being located on the respective containers in positions which are aligned in said state of complete assembling and provide a snapping action between the circular ridge and the annular recess when aligned for locking the second container in the first container.

4. The container assembly according to claim 3, wherein the containers are bottles.

5. The container assembly according to claim 4, wherein the bottom surface of the second container has deepenings.

6. The container assembly according to claim 2, wherein the containers are bottles.

7. The container assembly according to claim 6, wherein the bottom surface of the second container has deepenings.

8. The container assembly according to claim 1, wherein the containers are bottles.

9. The container assembly according to claim 1, wherein the bottom surface of the second container has deepenings.

* * * * *